US006540423B1

(12) United States Patent
Kugler et al.

(10) Patent No.: US 6,540,423 B1
(45) Date of Patent: Apr. 1, 2003

(54) METHOD AND APPARATUS FOR APPLYING MASTIC OR GRANULAR MATERIAL TO A ROOFING SURFACE

(76) Inventors: William E. Kugler, 2989 S. Detriot Way, Denver, CO (US) 80210; Stephen J. Knight, III, 4520 W. Wagontrail Dr., Littleton, CO (US) 80123

( * ) Notice: Subject to any disclaimer, the term of this patent is extended or adjusted under 35 U.S.C. 154(b) by 0 days.

(21) Appl. No.: 09/952,977

(22) Filed: Sep. 14, 2001

(51) Int. Cl.[7] ..... A46B 11/00

(52) U.S. Cl. ..... 401/48; 401/188 R; 118/108; 118/207

(58) Field of Search ..... 401/48, 188 R, 401/118, 140, 261; 118/108, 207, 305

(56) References Cited

U.S. PATENT DOCUMENTS 3,208,094 A * 9/1965 Pilkington ..... 401/48
4,055,384 A * 10/1977 Palzer ..... 401/48
5,358,347 A 10/1994 Morris ..... 401/48
5,366,309 A * 11/1994 Springall ..... 401/48
5,419,647 A 5/1995 Kirk et al. ..... 401/48
5,552,014 A 9/1996 Morris ..... 156/577
5,600,929 A 2/1997 Morris ..... 52/309.8
6,102,615 A * 8/2000 Wilson, Sr. ..... 404/111
6,183,156 B1 * 2/2001 Morris ..... 401/48

* cited by examiner

*Primary Examiner*—David J. Walczak
(74) *Attorney, Agent, or Firm*—Sheridan Ross P.C.

(57) ABSTRACT

A portable apparatus adapted for applying an adhesive and mastic roofing material is provided which allows one operator to use smaller, more maneuverable containers of roofing mastic for use in applying roofing materials and adhesives to roofing surfaces.

24 Claims, 6 Drawing Sheets

METHOD AND APPARATUS FOR APPLYING MASTIC OR GRANULAR MATERIAL TO A ROOFING SURFACE

FIELD OF THE INVENTION

The present invention relates to portable self contained apparatus used for the application of bulk adhesive mastic material and roofing materials associated therein.

BACKGROUND OF THE INVENTION

Roofing materials have been used for centuries to adequately seal a roof structure to prevent the encroachment of water and other elements. These materials have developed over time from straw, thatch and mud type roofs to shingles and roofing felt, along with metal roofs and composite materials such as tile. These materials are all designed to provide a cost effective method of sealing a roofing structure from the elements to prevent inherent damage to the building structure and provide a dry, comfortable living or working environment for the occupants of the structure.

One type of roof commonly used in the commercial roofing industry is a composite roof which utilizes a felt or composite roofing material applied over the roof's structural surface and secured with an unheated viscous adhesive material such as roofing mastic. The roofing mastic serves to adhere the felt roofing material to the top of the roof structure. Once the felt or other impermeable material is in place, mineral granules or gravel or other similar materials are usually applied on top of the completed roofing membrane for protection from the ultraviolet rays of the sun, hail, snow and other environmental conditions.

One significant problem which exists during commercial roofing operations is the application of the adhesive mastic material to a roofing surface, which requires significant volumes of mastic material to be applied to the roofing surface. To accommodate transporting the adhesive mastic material from the ground level to the roofing surface, large cranes and/or self contained truck pumping units are required which are expensive and require a significant capital investment and trained manpower to operate. These self contained units typically weigh thousands of pounds and hold hundreds of gallons of mastic material in one or more compartments. Further, the pumping equipment necessary to pump high volumes of extremely viscous mastic material from a street level to a roofing surface is significant, and the horse power required and fuel associated therein is not cost effective for smaller roofing surfaces. One such apparatus is described in U.S. Pat. No. 5,358,347 to Morris, which discloses a roof mastic applicator which is used in connection with a large reservoir positioned on the ground level and interconnected to a larger pump and associated truck to transport the mastic material to a roofing surface.

Accordingly, a significant need exists for a portable mastic application apparatus which may be operated by one man and which can be used in conjunction with smaller mastic containers such as five gallon pails which can be transported quickly and easily without the necessity of heavy pumping equipment and trucks. There is an additional need for a system and method for applying the adhesive mastic material to a roofing surface while simultaneously applying the bulk felt roofing material on top of the mastic material at the same time, thus saving significant time and expense. Finally, there is an additional need for an apparatus which can simultaneously apply the roofing mastic material and a bulk granular material such as mineral granules, at the same time. Accordingly, an apparatus and associated method which are designed to address these problems are provided herein as set forth below.

SUMMARY OF THE INVENTION

It is thus one aspect of the present invention to provide a self contained, portable pumping apparatus which is adapted to apply an adhesive mastic material to a roofing surface, and which can be operated by one person. Alternatively, the apparatus may be used to apply sealing materials to asphalt driveways, parking lots and other surfaces. Thus, in one embodiment of the present invention, a hand cart is provided which is controlled by one man and which supports a small container of mastic material and an associated pump, which is connected to a discharge manifold. The discharge manifold is designed to selectively apply a predetermined volume of mastic material to a roofing surface, the thickness of which can be controlled by the speed of operation of the self-contained unit. The mastic material is generally stored in a small container such as a 5–10 gallon pail which can easily be transported by one or two men to a roofing surface, as opposed to requiring a large pumping unit positioned on the ground level or the lifting of a large bulk container with a crane or other similar device.

It is another aspect of the present invention to provide a spreading means which applies a consistent thickness of mastic material on the roofing surface. Thus in one embodiment of the present invention a spreader bar is interconnected to the discharge manifold in a downstream position and which simultaneously spreads the mastic material on the roofing surface as it is discharged from a discharge port or a plurality of valves. In a further embodiment of the present invention, an oscillating motion may be applied to the spreader bar which further enhances the uniform application of the mastic material to the roofing surface.

It is yet another aspect of the present invention to provide a portable pumping unit which can be controlled from pneumatic compressed air or other readily available power sources common to the construction industry. Thus in other embodiments of the present invention a small gas operated pump may be used or an electric pump with sufficient horsepower to pump a viscous mastic material from a container through a discharge manifold on to a roofing surface. As discussed herein, the term "adhesive mastic" applies to all types of viscous, adhesive materials commonly used in the construction and roofing trades, as well as sealants for asphalt driveways and other surfaces. One example of such a material is an asphaltic modified bitumen adhesive such as modified bitumen adhesive (MBR) which is manufactured and sold by the Johns Manville™ Companies.

It is another aspect of the present invention to provide a device which can apply a mastic material and a bulk roofing material such as rolled felt simultaneously. Thus, in one embodiment of the present invention a support member is operably interconnected to the frame of the portable apparatus and which extends outwardly in a position immediately downstream from the discharge manifold. As the adhesive mastic is selectively applied to the roofing surface, the bulk roofing material may be rolled on to the roofing surface simultaneously, yet requiring only one man to operate the machine.

In a further aspect of the present invention, a bulk discharge container may be mounted downstream of the discharge manifold, and which applies a bulk granular material such as mineral granules or gravel. Thus, in one embodiment of the present invention the support member may be used to hold a container similar to a fertilizer spreader and which can hold between five and fifty pounds of mineral granules or pea gravel, or other similar materials which can be selectively dispensed on top of the mastic in applications where a felt roofing material or other similar materials are not used, or used in combination therein. Alternatively, the granular materials could be dispensed independently with the same portable machine and without applying the mastic material.

It is yet another aspect of the present invention that the portable apparatus be self propelled to assist the operator. In one embodiment of the present invention, a small motor may be used with associated gears, chains or belts interconnected to the wheels to provide a constant speed of travel, and to reduce the fatigue associated with operating the machine on a hot roofing surface.

It is yet another aspect of the present invention to provide a hand held wand which may be interconnected to the discharge end of the pump in combination with the discharge manifold. In this application, an operator may selectively operate the handheld wand to provide a single, selective bead of mastic material along the lap edge of roll roofing in a predetermined location, without utilizing the discharge manifold and associated dispensing ports. In this embodiment, the handheld wand may have a trigger mechanism or other similar apparatus which is used by the operator to selectively control the volume of mastic dispensed from the wand.

It is yet another aspect of the present invention to provide a separate manifold that can apply a continuous bead of roofing insulation adhesive to and along the top flanges of a structured steel roof deck so to apply the viscous adhesive in ribbons on varying and selective locations and varying rates and locations for the purpose of installing preformed roof insulation boards.

Thus, in one aspect of the present invention, a portable apparatus which is adapted for applying an adhesive mastic and roofing material is provided herein, and comprising:

a frame;

at least one wheel rotatably interconnected to said frame;

a platform interconnected to said frame for supporting a container of the adhesive mastic material;

a pump interconnected to said frame and comprising a suction end and a discharge end, said suction end operably positioned to communicate with the container of the adhesive mastic material;

a discharge manifold in operable communication with said discharge end of said pump and adapted for being pulled across a roofing surface;

at least one dispensing port positioned on said discharge manifold for discharging the adhesive mastic material onto the roofing surface; and a support member operably interconnected to said frame and adapted for holding a roll of roofing material in a downstream position from said discharge manifold, wherein the roofing material can be applied to the roofing surface over the adhesive mastic material while the apparatus is being pulled along the roofing surface.

DETAILED DESCRIPTION

Figure 1:
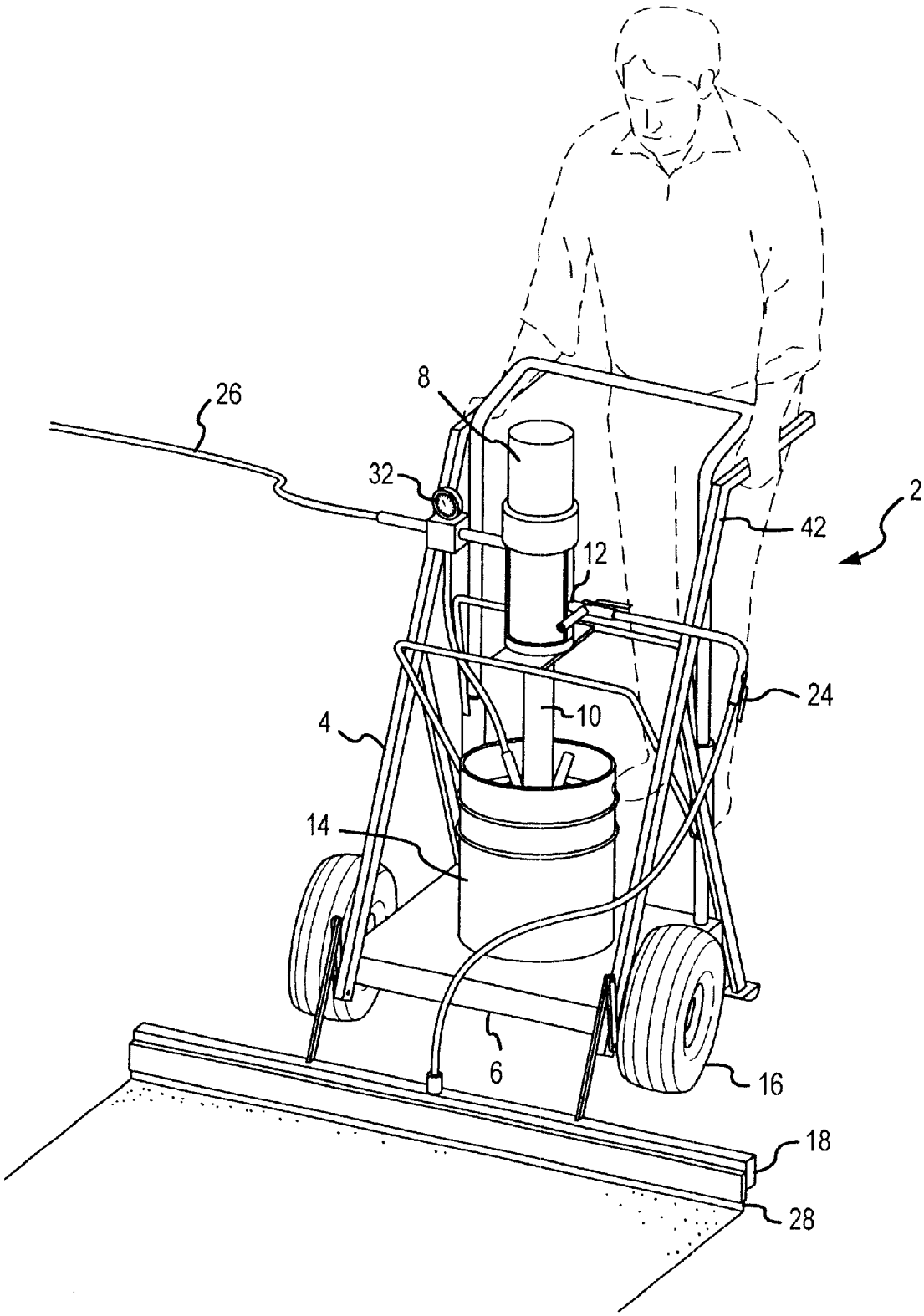
FIG. 1 is a front perspective view of the present invention in use.

Referring now to the drawings, FIGS. 1–6 are provided herein to more accurately describe the present invention and the components associated therein. Referring now to FIG. 1, a front perspective view of the present invention is provided and which generally shows the numerous components of the device and the position of an operator during use. More specifically, the portable mastic applicator 2 is generally comprised of a frame 4 which is typically constructed of a metal or other substantially rigid material and which has a platform 6 interconnected on a lower end. The substantially planar platform 6 is designed to support an adhesive container 14 such as a five gallon pail or other portable device. The adhesive container 14 is operably positioned below a pump 8, which is driven by pneumatic pressure in one embodiment, and thus interconnected to a pneumatic injection line 26. For operational purposes, a compressor (not shown) is used to provide the compressed air for the pneumatic injection line 26. Alternatively, the pump may be driven by a gas or electric powered motion.

As discussed herein, the term "adhesive mastic" refers to any type of viscous material such as glues, adhesions, coatings, paints, sealants and other similar materials which may be applied in bulk. Thus, it is anticipated that the present invention may be utilized to disperse materials having a viscosity of between about 120,000 centipoise ("cp") and 10,000 cp at a temperature of between about 40° F. and 100° F. For applications in the roofing industry, mastic materials such as MBR adhesive and per mastic adhesive maybe dispensed from the apparatus, and which generally have a viscosity of between about 11,000 cp and 20,000 cp.

The discharge port or dispensing channel 20 preferably has a cross-sectional area of at least about 0.3 $in^2$ to provide a sufficient opening to dispense an adequate amount of adhesive mastic material. In a typical application, the mastic material is applied to a thickness of between about ⅙ inches and ⅛ inches to the roofing surface. Thus, the pump 8 of the present invention is typically required to provide a discharge rate of at least about 1 to 2½ gallons per minute (gpm) to provide a sufficient amount of adhesive mastic through the discharge port, which preferably has a length of between 24 inches and 60 inches.

The pump 8 generally has a pump suction end 10, which is in operable communication with the mastic material contained in the adhesive container 14. The pump 8 further comprises a pump discharge end 12 which is interconnected to a downstream line for transporting the mastic material to a discharge manifold 18. This line may be comprised of screwed metallic pipe and/or high pressure pneumatic line which is commonly known in the art. To selectively interrupt communication from the pump discharge end 12 to the discharge manifold 18, one or more valves 24 are provided as shown.

Furthermore, although in a preferred embodiment the pump 8 is positioned above the mastic container 14, it is feasible that the pump could be positioned below the platform 6 and associated mastic container 14. Thus, the respective positioning of the pump 8 and mastic container 14 is not critical to the present invention as long as there is communication between the mastic container 14 and the pump suction 10.

Figure 2:
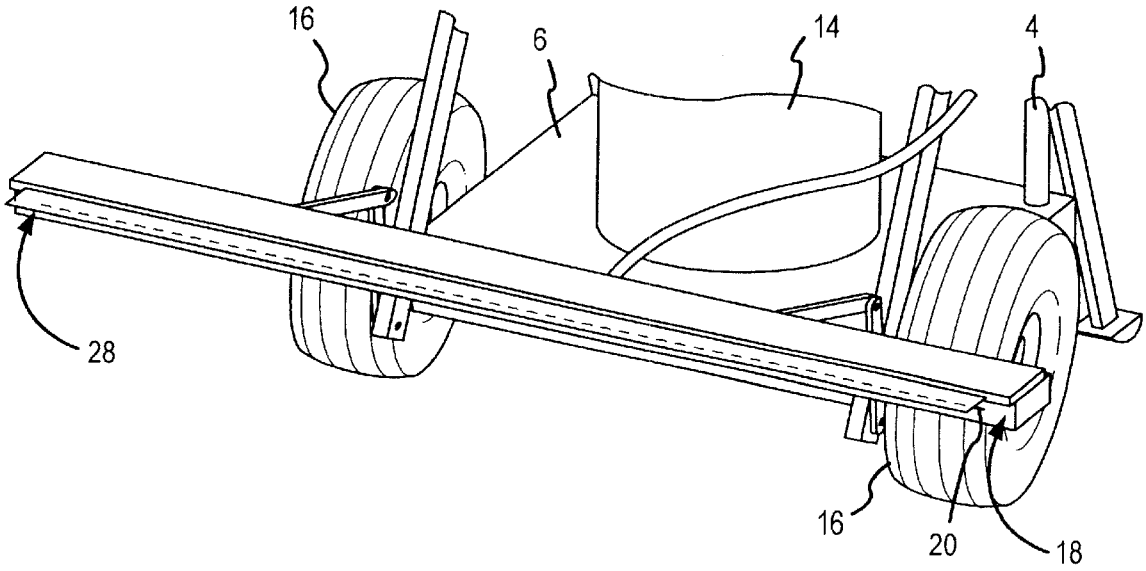
FIG. 2 is a front perspective view of the invention shown in FIG. 1 and providing more detail with regard to a discharge manifold and spreader bar.

Positioned on the distal end of the discharge line, a discharge manifold is provided and is shown in greater detail in FIG. 2. The discharge manifold 18 in one embodiment comprises a metallic pipe or rectangular shaped mechanism with one or more dispensing ports 20 which extend substantially from one end of the discharge manifold 18 to the opposing end. Alternatively, one or more individual dispensing ports 20 may be utilized, and which may or may not have individual valves 24 associated therewith to selectively control the amount and position of mastic being dispensed. The discharge manifold 18 is interconnected to the frame by a handle mechanism 42 which has a hinge 40 positioned proximate to the wheels 16, and allows the discharge manifold 18 to be selectively raised and lowered by the operator as necessary. As further identified, in FIG. 2, one or more wheels 16 are generally interconnected to a lower portion of the frame 4, and which allows the apparatus to be easily moved from one position to another at a rate of speed determined by the operator.

Figure 4:
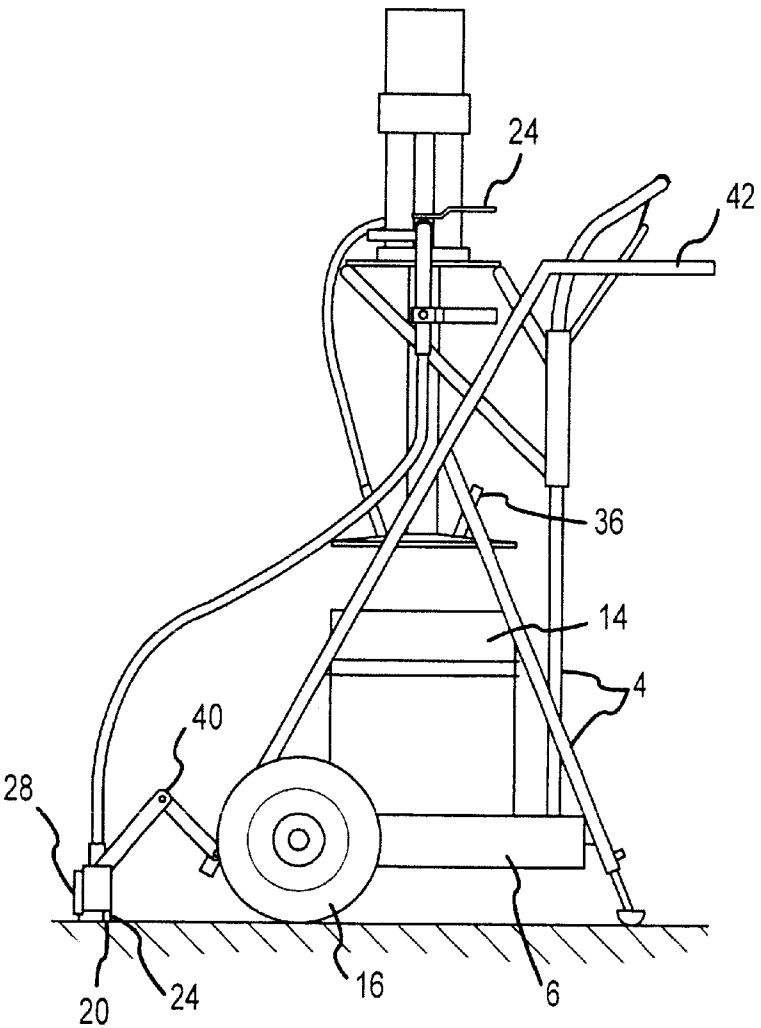
FIG. 4 is a right elevation view of the invention shown in FIG. 1.
Figure 3:
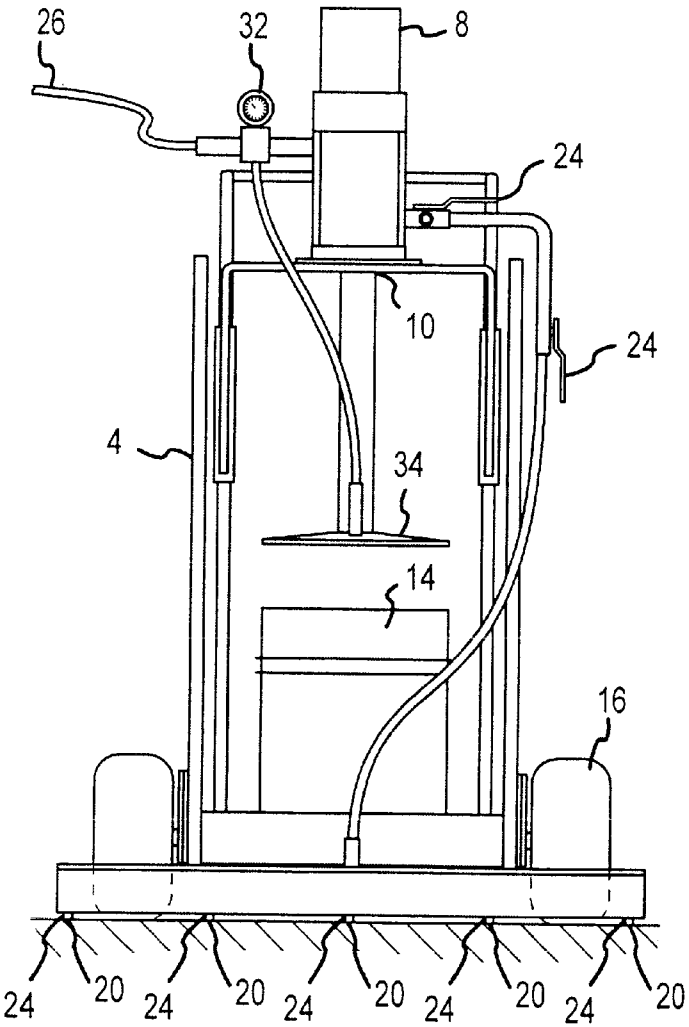
FIG. 3 is a front elevation view of the invention shown in FIG. 1.

Referring now to FIG. 3 and FIG. 4, a front elevation view and a right elevation view of the present invention is provided herein respectively. As depicted, the pneumatic injection line 26 is in communication with a pressure gauge 32, and has a secondary line extending to a container inductor plate 34. The container inductor plate 34 has an exterior diameter which is operably sized to fit the internal diameter of the adhesive container 14, and which provides a sealing mechanism to assure the communication of the roofing mastic material from the adhesive container 14 through the pump 8 and the discharge line to the discharge manifold. To assist in removing the induction plate 34 from the container 14, a valve 24 is closed preventing air intake to the pump 8, and allowing compressed air to be injected into the container 14, which provides an upward force which pushes the inductor plate upward from the container opening. A pressure relief valve 36 is also provided on the inductor plate 34 to release pressure in the container as necessary, and is also opened to allow air to escape as the inductor plate 34 is positioned within the container 14.

As additionally seen in FIG. 4, a hinge mechanism 40 may be provided between the frame 4 and the discharge manifold 18, which can be moved to selectively put the discharge manifold in a downward position as shown, or elevated to allow transportation of the apparatus. Thus, in one embodiment of the present invention, one portion of the frame 4 is used to support the platform 6, wheels 16, pump 8 and other associated componentry, while another portion of the frame 4 is used to selectively raise and lower the discharge manifold 18.

As additionally seen in FIG. 2, in one embodiment of the present invention a spreader 28 is provided which selectively spreads the adhesive mastic material along a roofing surface as the apparatus is rolled. In an alternative embodiment to the present invention, an oscillating device may be used to oscillate the spreader 28 in a direction substantially parallel to the longitudinal access of the discharge manifold 18 to more effectively and uniformly apply the mastic material to the roofing surface. In one embodiment of the present invention, the spreader 28 is comprised of a rubber material, although other similar materials including fiberglass, metal, and plastic may be used for the same purpose. Alternatively, one or more chains may be used to apply the mastic material in a substantially uniform pattern over a roofing surface.

Figure 5:
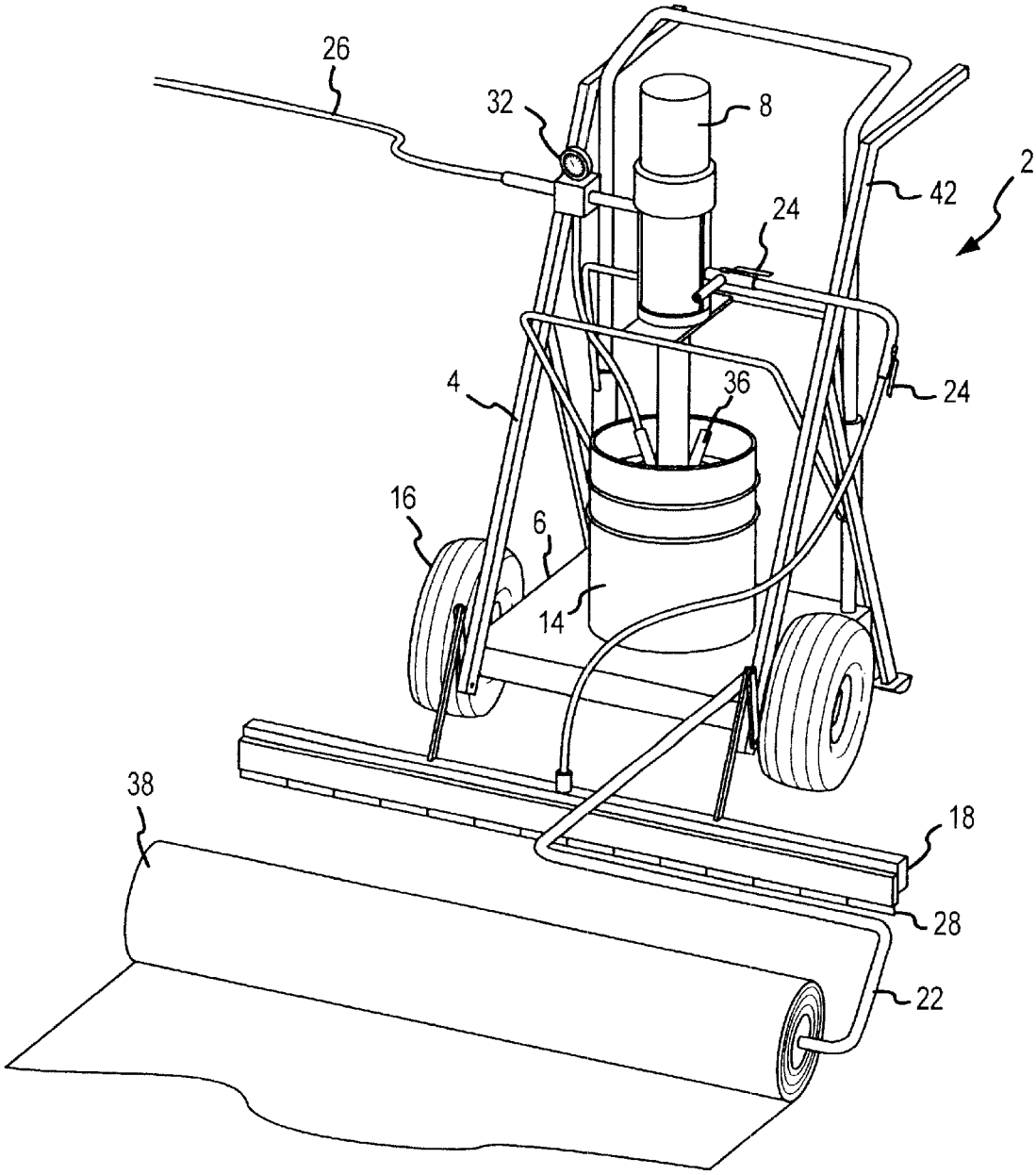
FIG. 5 is a front perspective view of the invention shown in FIG. 1, and further identifying a support member used to hold a roll of bulk roofing material.
Figure 7:
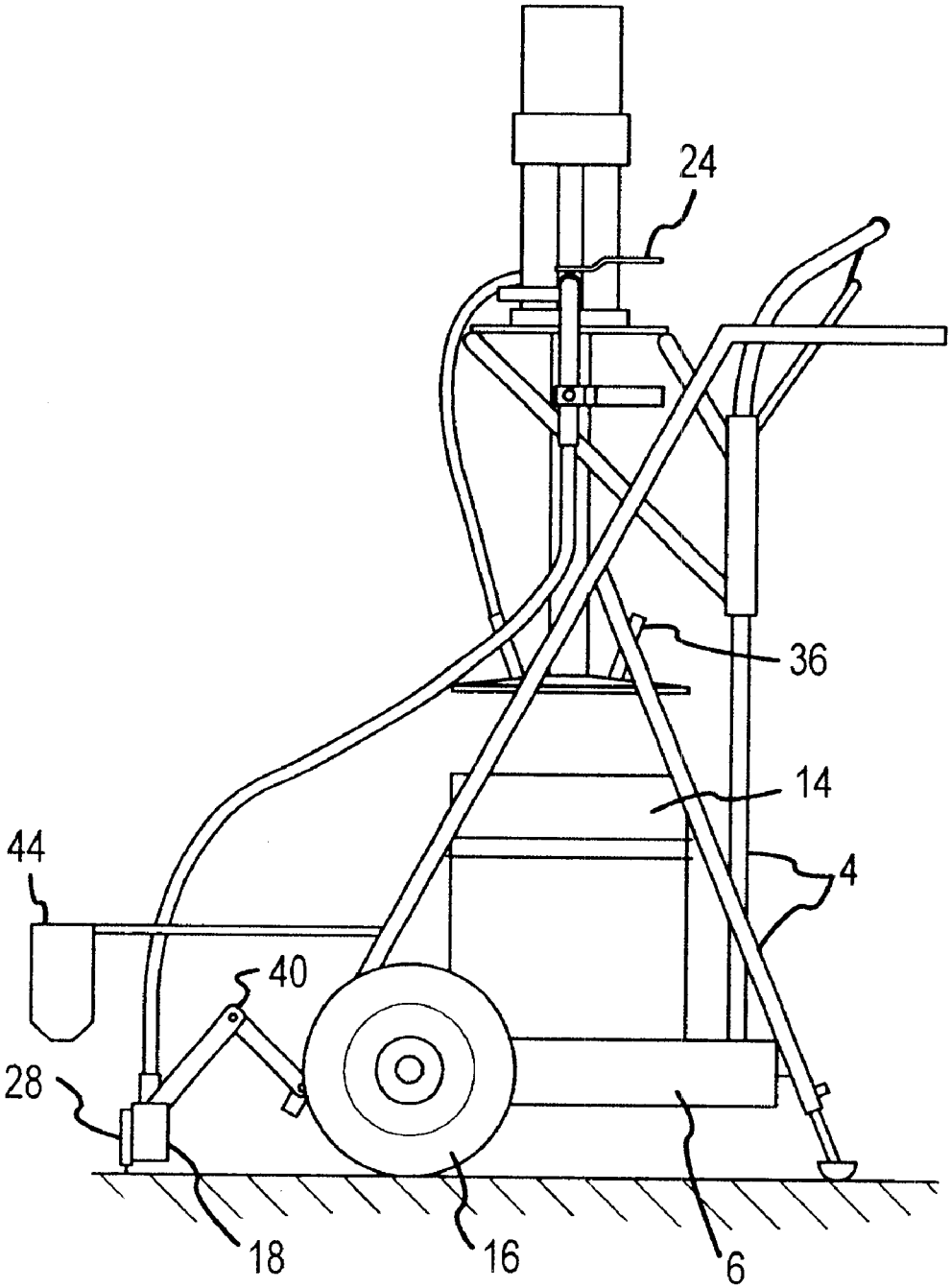
FIG. 7 is a left elevation view of the embodiment shown in FIG. 4, and further including a spreader for granular material.

Referring now to FIG. 5, another embodiment of the present invention is provided herein. More specifically, a support member 22 is interconnected to the frame 4 in a manner which positions the support member 22 immediately downstream of the portable mastic applicator 2. In this embodiment, a roll of bulk roofing material 38 such as felt is removably interconnected to the support member 22, in such a manner which allows the bulk roofing material 38 to unwind and be applied to the roofing surface. In this embodiment, as the mastic adhesive is applied through the discharge manifold 18 and spread with the spreader 28 or resilient flap or flaps while the bulk roofing material 38 is layed down uniformly on top of the mastic material. This embodiment allows both the mastic material 38 and roofing material to be applied to the roofing surface simultaneously, and hence saves manpower, time and installment costs. In an alternative embodiment, a bulk ganular container 44 (see FIG. 7) may be installed on the support member 22 or associated frame 4, which allows granular material such as mineral granules, gravel, or other materials to be applied to the roofing surface downstream of the discharge manifold 18.

Thus, the present invention is adapted for a variety of uses to either independently apply a roofing mastic material, or can be used in combination with bulk roofing materials 38 such as felt or cap sheets, or alternatively with bulk roofing materials such as pea gravel, sand or other materials to a roofing surface. As appreciated by one skilled in the art, the present invention may be used to either independently apply the mastic material, bulk roofing material such as felt or granular material such as gravel, or alternatively may be used to apply all three simultaneously.

Figure 6:
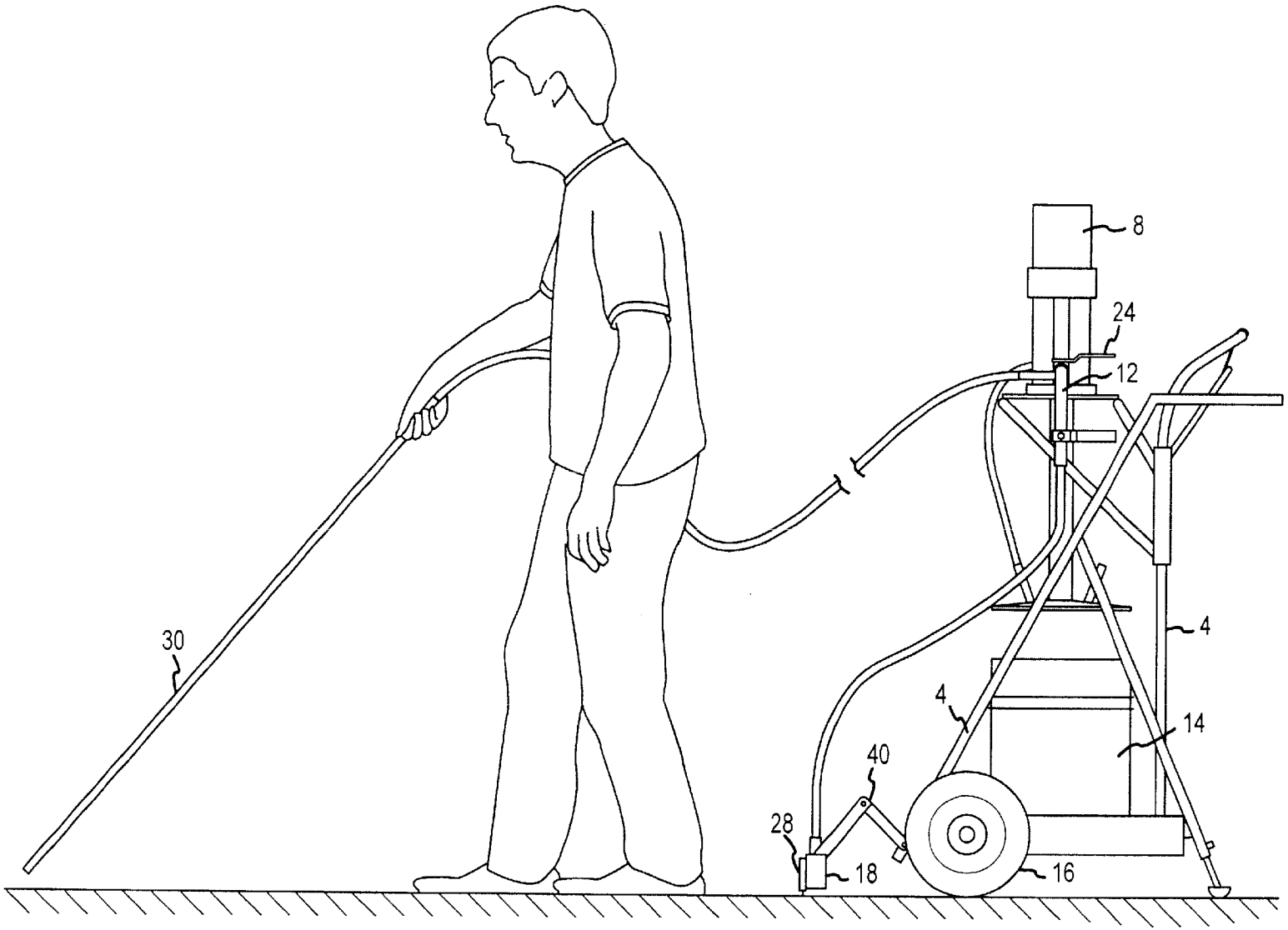
FIG. 6 is a right elevation view of an alternative embodiment of the invention shown in FIG. 1, and identifying the use of a handheld wand for selective application of the adhesive mastic material.

Referring now to FIG. 6, an alternative embodiment of the present invention is provided wherein a handheld wand is provided for use by the operator to selectively apply a single bead of mastic material in a desired location. By closing the valve 24, the flow of adhesive mastic material to the discharge manifold 18 is prevented, while an additional valve 24 is opened, and thus allowing the mastic material to be discharged through the handheld wand 30 in a predetermined location for use along seams, comers, and other hard to reach locations where the adhesive mastic material is required. When not in use, the handheld wand 30 and associated hose may be disconnected from the apparatus or stored in an unobstructed position.

In a further embodiment of the present invention not shown, a self contained motor may be utilized in conjunction with the present invention to allow the apparatus to be self propelled. In this embodiment, a small electric, gas operated, or pneumatic motor may be interconnected to the frame with a gearing mechanism and associated chain or belt to drive the wheels at a predetermined speed as determined by the operator. This feature may allow for a larger sized adhesive container 14 to be used in a range of 10 to 50 gallons, or allow heavier roofing bulk materials 38 to be suspended from the support frame 4 while providing ease of operation and reduced fatigue for the operator.

To provide clarity to the present invention, a detailed list of the following components and the associated numbering therein is provided for reference purposes.

| # | Component |
|---|---|
| 2 | Portable Mastic Applicator |
| 4 | Frame |
| 6 | Platform |
| 8 | Pump |
| 10 | Pump Suction End |
| 12 | Pump Discharge End |
| 14 | Adhesive Container |
| 16 | Wheels |
| 18 | Discharge Manifold |
| 20 | Dispensing Port |
| 22 | Support Member |
| 24 | Valve |
| 26 | Pneumatic Injection Line |
| 28 | Spreader |
| 30 | Handheld Wand |
| 32 | Pressure Gauge |
| 34 | Container Inductor Plate |
| 36 | Pressure Relief Valve |
| 38 | Bulk Roofing Material |
| 40 | Hinge |
| 42 | Handle Mechanism |

While various embodiments of the present invention have been described in detail, it is apparent that modifications and adaptations of those embodiments will occur to those skilled in the art. However, it is to be expressly understood that such modifications and adaptations are within the spirit and scope of the present invention, as set forth in the following claims.

What is claimed is:

1. A portable apparatus adapted for applying an adhesive mastic and roofing material, comprising:

a frame;

at least one wheel rotatably interconnected to said frame;

a platform interconnected to said frame for supporting a container of the adhesive mastic material;

a pump interconnected to said frame and comprising a suction end and a discharge end, said suction end operably positioned to communicate with the container of the adhesive mastic material;

a discharge manifold in operable communication with said discharge end of said pump and adapted for being pulled across a roofing surface;

at least one dispensing port positioned on said discharge manifold for discharging the adhesive mastic material onto the roofing surface; and a support member operably interconnected to said frame and adapted for holding a roll of roofing material in a downstream position from said discharge manifold, wherein the roofing material can be applied to the roofing surface over the adhesive mastic material while the apparatus is being pulled along the roofing surface.

2. The apparatus of claim 1, wherein said at least one dispensing port on said discharge manifold comprises a dispensing channel having a cross-sectional area of at least about 0.3 square inches.

3. The apparatus of claim 1, wherein said at least one dispensing port on said discharge manifold further comprises a plurality of valves for selectively applying said adhesive mastic to the roofing surface in a predetermined pattern.

4. The apparatus of claim 1, further comprising a spreader operably interconnected to said frame and positioned downstream of said discharge manifold for selectively spreading the adhesive mastic material as it is dispensed onto the roofing surface.

5. The apparatus of claim 4, wherein said spreader further comprises at least one resilient flap for contacting the adhesive mastic.

6. The apparatus of claim 1, wherein said pump is capable of pumping the adhesive mastic material at a rate of at least about 1 (one) gallons per minute when the adhesive mastic material has a viscosity of at least about 100,000 centipoise at an ambient temperature of about 50° F.

7. The apparatus of claim 1, wherein said container is a five gallon pail.

8. The apparatus of claim 1, further comprising a granular dispensing container operably interconnected to said frame for applying a granular material on the adhesive mastic material after the adhesive mastic material is applied to the roof.

9. The portable apparatus of claim 1, wherein said pump is operated with air pressure.

10. The portable apparatus of claim 1, further comprising a hand-held wand in operable communication with said discharge end of said pump which can be operated to selectively provide a bead of said adhesive mastic material to a predetermined location.

11. A combination of a portable container, for holding a viscous liquid and an apparatus adapted for applying the viscous liquid to a surface, comprising:

a portable container adapted for holding the viscous liquid;

a frame to operably support said portable container;

at least one wheel rotatably interconnected to said frame;

a pump mechanism operably engaged to said frame and comprising a suction end and a discharge end, said suction end in operable communication with said portable container;

a container inductor plate interconnected to said suction end of said pump mechanism for sealingly engaging an open end of said portable container;

a manifold interconnected to said frame and in operable communication with said discharge end of said pump; and at least one dispensing port in operable communication with said manifold for discharging the viscous liquid on the surface.

12. The combination of claim 11, wherein said portable container holds no more than about 10 gallons.

13. The combination of claim 11, wherein said at least one dispensing port is a channel cut in a lower surface of said manifold.

14. The combination of claim 11, wherein said at least one dispensing port comprises a plurality of apertures positioned in said manifold.

15. The combination of claim 14, further comprising valves interconnected to said plurality of apertures which can be selectively adjusted to modify the volume of viscous liquid discharged from said apertures.

16. The combination of claim 11, further comprising a spreader interconnected to said frame and positioned downstream from said manifold for evenly applying the viscous liquid to the surface.

17. The combination of claim 11, further comprising:

a support member interconnected to said frame which is adapted for holding a roll of roofing material in a downstream position from said manifold, wherein the roofing material can be applied over the viscous liquid while the apparatus is being pulled along a roofing surface.

18. The combination of claim 11, further comprising:

a hand-held wand in operable communication with said discharge end of said pump mechanism, wherein said hand-held wand can be selectively operated to provide a stream of said viscous liquid to a predetermined location.

19. A method for applying a viscous material to a roofing surface, comprising the steps of:

providing a frame;

supporting a portable storage device containing the viscous material on said frame;

interconnecting a suction end of a pumping mechanism to the portable storage device;

sealing said portable storage device from an outside atmosphere;

activating said pump to transfer a volume of the viscous material from said portable storage device to a discharge manifold comprising at least one dispensing port;

dispensing the viscous material at a predetermined rate from said at least one dispensing port onto the surfaces.

20. The method of claim 19, further comprising the step of spreading the viscous material on the surface.

21. The method of claim 19, further comprising the step of applying a roofing material on top of the viscous material.

22. The method of claim 19, wherein said dispensing port comprises a dispensing channel having a diameter of at least about 0.01 inches.

23. The apparatus of claim 11, wherein said viscous liquid is an adhesive mastic material.

24. The apparatus of claim 11, wherein said viscous liquid comprises a sealant material.

* * * * *